US007356267B2

(12) United States Patent
Kim et al.

(10) Patent No.: US 7,356,267 B2
(45) Date of Patent: Apr. 8, 2008

(54) JAM REMOVING METHOD AND PRINTER USING TONER SAVE MODE

(75) Inventors: Hyoung-tae Kim, Suwon-si (KR); Yong-jo Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1 day.

(21) Appl. No.: 11/407,030

(22) Filed: Apr. 20, 2006

(65) Prior Publication Data

US 2006/0257157 A1 Nov. 16, 2006

(30) Foreign Application Priority Data

May 12, 2005 (KR) ..... 10-2005-0039801

(51) Int. Cl.
*G03G 15/00* (2006.01)
*G03G 21/00* (2006.01)

(52) U.S. Cl. ..... 399/21; 399/9; 399/320

(58) Field of Classification Search ..... 399/27, 399/40, 49, 231, 21; 347/151, 158; 400/366, 400/423

See application file for complete search history.

(56) References Cited

U.S. PATENT DOCUMENTS

| | | | | |
|---|---|---|---|---|
| 4,317,629 | A * | 3/1982 | Kuseski | 355/24 |
| 5,124,759 | A * | 6/1992 | Fukuchi et al. | 399/22 |
| 5,920,744 | A * | 7/1999 | Matsubara et al. | 399/19 |
| 6,081,341 | A * | 6/2000 | Kim | 358/1.14 |
| 6,081,677 | A * | 6/2000 | Maess et al. | 399/49 |
| 6,324,356 | B1 * | 11/2001 | Inoue | 399/39 |
| 6,529,693 | B2 * | 3/2003 | Tomizawa et al. | 399/44 |
| 6,718,145 | B2 | 4/2004 | Ohta et al. | |
| 6,804,479 | B2 * | 10/2004 | Kimura | 399/49 |
| 2002/0044784 | A1 * | 4/2002 | Kato | 399/27 |
| 2004/0067069 | A1 * | 4/2004 | Ogata | 399/27 |
| 2004/0213593 | A1 * | 10/2004 | Brewington et al. | 399/27 |
| 2005/0002678 | A1 * | 1/2005 | Kim | 399/21 |
| 2005/0053387 | A1 * | 3/2005 | Itoh | 399/27 |
| 2005/0105927 | A1 * | 5/2005 | Kayahara | 399/49 |
| 2005/0140087 | A1 * | 6/2005 | Sano et al. | 271/276 |
| 2005/0207765 | A1 * | 9/2005 | Ogata | 399/27 |

FOREIGN PATENT DOCUMENTS

| | | | |
|---|---|---|---|
| JP | 60083932 | A * | 5/1985 |
| JP | 09-52397 | | 2/1997 |
| JP | 09-197926 | | 7/1997 |
| JP | 09-272248 | A * | 10/1997 |
| JP | 11-052803 | | 2/1999 |
| JP | 2000293070 | A * | 10/2000 |
| KR | 1994-0000844 | | 2/1994 |
| KR | 1994-0006378 | | 7/1994 |

* cited by examiner

*Primary Examiner*—Daniel J. Colilla
*Assistant Examiner*—N. Ha
(74) *Attorney, Agent, or Firm*—Stanzione & Kim, LLP

(57) ABSTRACT

A jam removing method and printer using toner a save mode includes detecting a paper jam on a printing route, confirming whether a dot count value of a corresponding image exceeds a preset boundary value, and converting a printing mode into the toner save mode when the dot count value exceeds the boundary value. The paper jam by an image density is prevented from repeating, and successive paper jam is prevented from occurring, user's convenience may be enhanced, and the toner may not be wasted.

23 Claims, 4 Drawing Sheets

JAM REMOVING METHOD AND PRINTER USING TONER SAVE MODE

CROSS-REFERENCE TO RELATED APPLICATIONS

This application claims benefit under 35 U.S.C. § 119(a) of Korean Patent Application No. 2005-39801, filed on May 12, 2005, the entire contents of which are incorporated herein by reference.

BACKGROUND OF THE INVENTION

1. Field of the Invention

The present general inventive concept relates to a jam removing method and printer. More particularly, the present general inventive concept relates to a jam removing method and printer using a toner save mode.

2. Description of the Related Art

Paper jam occurs when a paper printed is not normally sent back in a system during printing. The paper jam during printing causes inconveniences to a printer user.

In order to detect the paper jam, 2 sensors (first and second sensors) are generally employed for a printer. The first sensor is mounted at a feeding part in the printer and the second sensor is mounted at a rear end of a fixing part in the printer.

The jam in the printer is divided into 3 types, for examples, JAM0, JAM1, and JAM2 according to a place of occurrence.

JAM0 occurs when a front end of the paper fails to pass the first sensor a predetermined time after the paper printed was supplied. JAM1 occurs when the front end of the paper fails to pass the second sensor a predetermined time after the front end of the paper passed the first sensor. JAM2 occurs when a rear end of the paper printed fails to pass the second sensor a predetermined time after the front end of the paper printed passed the second sensor.

The jam may occur by an excessive image density and the jam caused by the image density may occur in a case that the image to be printed is dark or dense.

The dark image to be printed needs a large amount of toner to be deposited on the paper for printing and while the large amount of toner is compressed by the fixing part, the paper is stuck is the fixing part.

Since the jam by the image density occurs during a process of compressing the toner by the fixing part, the above-mentioned JAM2 generally occurs in this case.

FIG. 1 is a view illustrating a conventional printer. The printer includes a controlling part 10, an engine part 30, a sensing part 50, and a indicating part 70. The sensing part 50 includes a first sensor 53 and a second sensor 57.

The controlling part 10 sequentially performs printing according to information received from an emulating part (not shown), and the engine part 30 receives an image corresponding to the information to be printed from the controlling part 10 and performs printing.

The sensing part 50 confirms an occurrence of a paper jam. More specifically, the first and second sensors 53 and 57 detect the occurrences of JAM0, JAM1, and JAM2.

The indicating part 70 receives an indication signal from the controlling part 10 which has received a signal on the occurrence of the paper jam from the sensing part 50, and indicates whether the printer is in a paper jam state or printable state.

FIG. 2 is a flowchart illustrating a method of removing paper jammed in the conventional printer of FIG. 1.

Referring to FIGS. 1 and 2, the sensing part 50 detects the occurrence of the paper jam in S100, and if there is no paper jam, the sensing part does not send any additional signal to the controlling part 10 and the printing continues in S190.

The sensing part 50 detects the occurrence of the paper jam. The sensing part 50 sends a paper jam occurrence signal to the controlling part 10 and the controlling part 10 transmits the indication signal to the indicating part 70. The indicating part 70 indicates the occurrence of the paper jam in S110.

A user manually confirms the indication of the paper jam occurrence of the indicating part 70, manually open a cover of the printer, and manually removes a paper jammed. The user closes a cover of the printer and the sensing part 50 confirms that the paper jammed is removed whenever the cover of the printer is closed, S130.

The sensing part 50 confirms whether the paper jammed was removed or not and transmits a signal according to the removal of the jammed paper to the controlling part 10. The controlling part 10 judges whether the paper was removed through the signal in S150.

If the controlling part 10 judges that the paper was removed, the controlling part transmits a signal to the indicating part 70 to indicate a printable state. The indicating part 70 receives the signal from the controlling part 10 and indicates the printable state in S170.

The controlling part 10 transmits the image to be printed to the engine part 30, and the engine part 30 prints the image that has been failed to be printed due to the occurrence of the paper jam in S190.

The above-mentioned conventional printer is effective in paper jam occurring due to a defective paper, but can not solve a problem when it is caused by the image density.

As mentioned above, the paper jam by the image density occurs due to the large amount of toner. Even if a user removes the paper jammed, if the amount of toner is not controlled, the paper jam will repeat.

SUMMARY OF THE INVENTION

An aspect of the present general inventive concept provides a jam removing method and printer using a toner save mode to remove a paper jam caused by an image density.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a jam removing method comprising detecting a paper jam on a printing route, confirming whether a dot count value of a corresponding image exceeds a preset boundary value, and converting a printing operation of the image into a toner save mode when the dot count value exceeds the boundary value.

The detecting of the paper jam may comprise detecting the paper jam using a JAM2 sensor. In a case of occurrence of the paper jam by an image density, the paper jam may be detected by a JAM2 sensor.

The converting of the printing operation into the toner save mode may include indicating the conversion on either an indicating part of the printer or a displaying part of a host.

The converting of the printing operation into the toner save mode may include manually or automatically converting the printing operation into the toner save mode by user's selection.

The jam removing method may further include re-printing the image that has failed to be printed due to the paper jam, after the printing operation is converted into the toner save mode.

In a case of the paper jam, a paper jam state may be indicated.

After the conversion of the printing operation into the toner save mode, a printable state may be indicated.

The dot count value may be a preset value or be set by a user.

The foregoing and/or other aspects of the present inventive concept may also be achieved by providing image forming apparatus including a part sensing paper jam on a printing route, a dot counting part to output a dot count value of an image upon the occurrence of the paper jam, and a controlling part to convert a printing mode into a toner save mode when the dot count value transmitted from the dot counting part exceeds a preset boundary value.

The sensing part may include a JAM2 sensor to detect the paper jam.

When the paper jam occurs according to an image density, the paper jam may be detected by the JAM2 sensor.

The toner save mode may be indicated either an indicating part of the printer or a displaying part of a host.

The printing mode may be manually or automatically converted into the toner save mode by the user's selection.

The image forming apparatus may further include an engine part to re-start printing in the toner save mode according to a command from the controlling part.

The image forming apparatus may further include an indicating part to indicate a paper jam state upon the paper jam and a printable state after converting the printer mode into the toner save mode.

The dot count value may be a preset value or settable by the user.

The foregoing and/or other aspects of the present inventive concept may also be achieved by providing image forming apparatus including a sensing part to detect an occurrence of a paper jam, and a controlling part to convert an printing mode into a toner save mode when the paper jam occurs by an image density.

The image forming apparatus may further include an engine part to re-start printing in the toner save mode according to a command from the controlling part.

The foregoing and/or other aspects of the present general inventive concept may also be achieved by providing an image forming system including a sensing part to sense a failure of a printing operation of printing an image on a printing medium with a first image density, and a controlling part to change the first image density of the image into a second image density according to the sensed failure of the printing operation.

The foregoing and/or other aspects of the present general inventive concept may also be achieved by providing an image forming system including a sensing part to sense a printing operation of an image, and a controlling part to change an image density of the image according to the printing operation.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
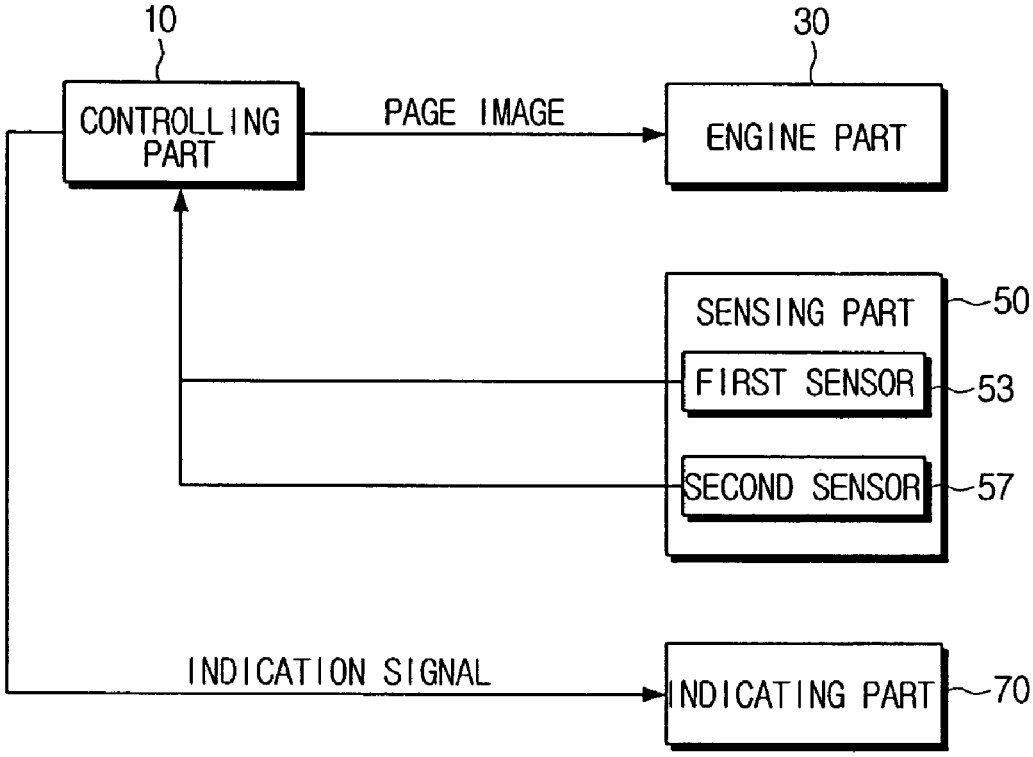
FIG. 1 (PRIOR ART)
FIG. 1 is a view illustrating conventional a printer.
Figure 2:
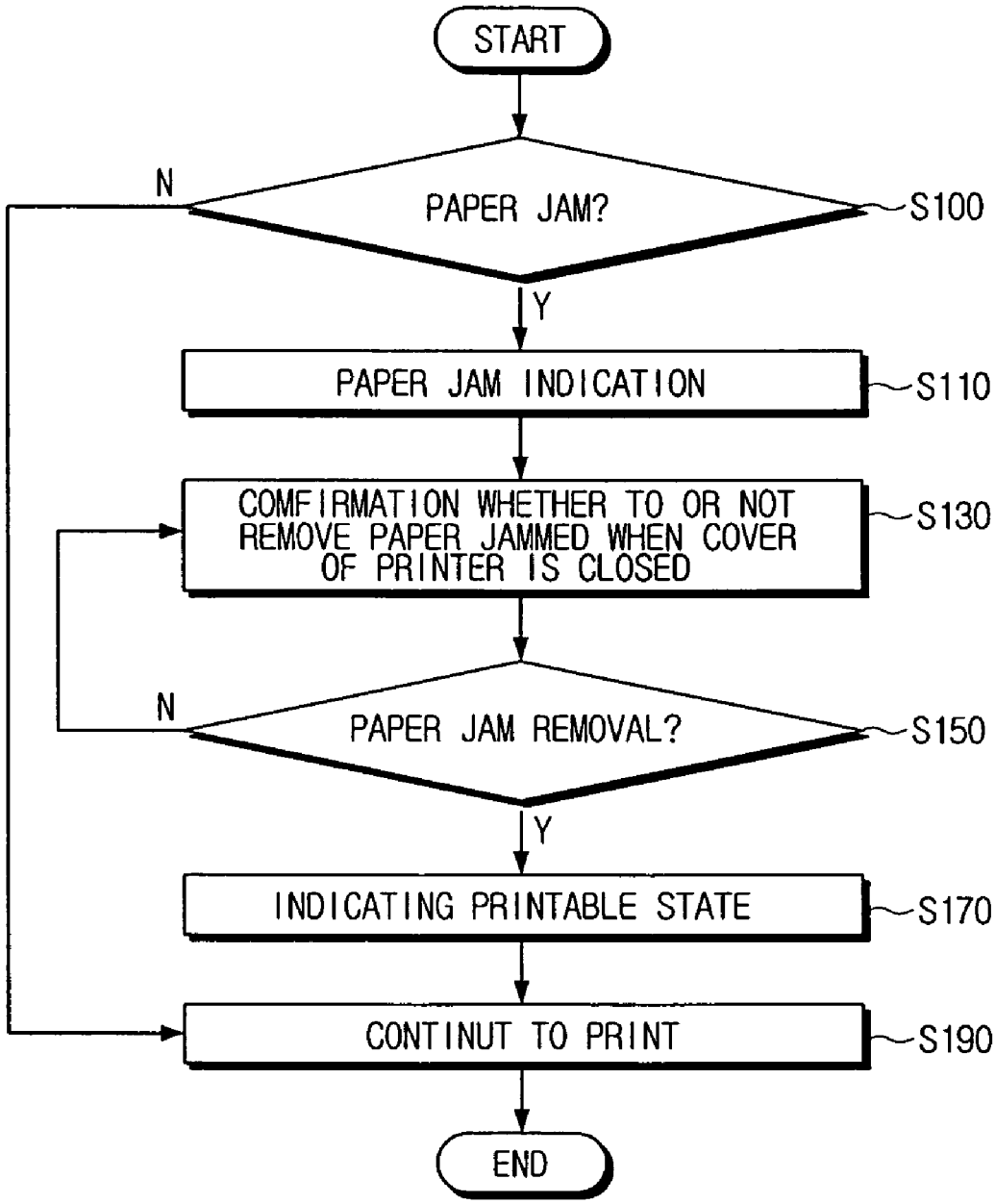
FIG. 2 (PRIOR ART)
FIG. 2 is a flowchart illustrating a jam removing method of the printer of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
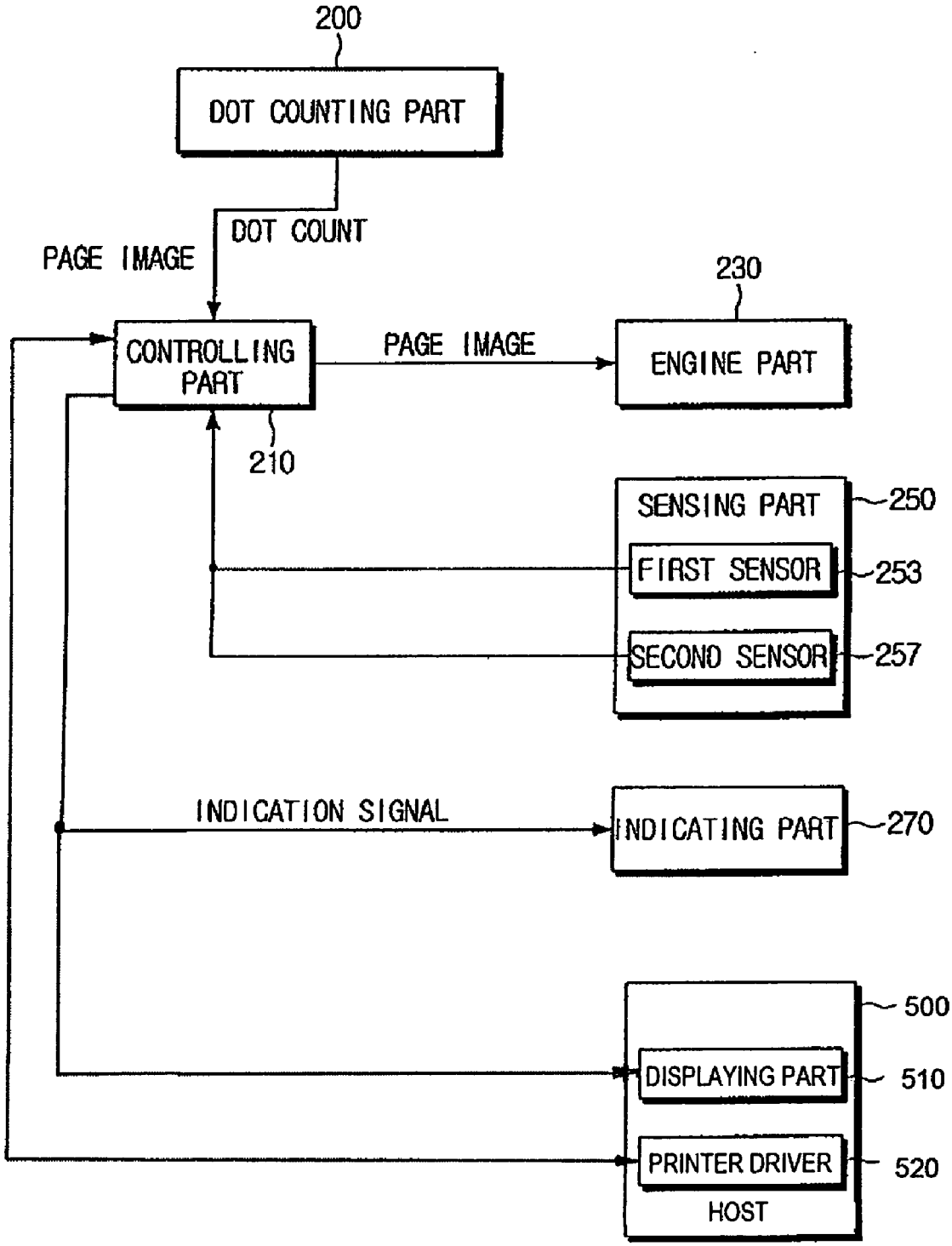
FIG. 3 is a view illustrating a printer according to an embodiment of the present general inventive concept.

FIG. 3 is a view illustrating a printer according to an embodiment of the present general inventive concept.

The printer includes a dot counting part 200, a controlling part 210, an engine part 230, a sensing part 250, and an indicating part 270. The sensing part 250 includes first and second sensors 253, 257.

The dot counting part 200 calculates and transmits a dot count value to the controlling part 210. The dot count value refers to the number of dots of at least one image which is printed. Accordingly, when the dot count value increases a larger amount of toner is used with respect to the image.

The controlling part 210 stores the received dot count value of the image to be printed. The engine part 230 receives the image to be printed from the controlling part 210 and performs a printing operation of the image.

The sensing part 250 confirms an occurrence of a paper jam. More specifically, the first sensor 253 and the second sensor 257 detect the occurrence of the paper jam. The paper jam may occur at JAM0, JAM1, and JAM2. JAM0 occurs when a front end of the paper fails to pass the first sensor a predetermined time after the paper printed was supplied. JAM1 occurs when the front end of the paper fails to pass the second sensor a predetermined time after the front end of the paper passed the first sensor. JAM2 occurs when a rear end of the paper printed fails to pass the second sensor a predetermined time after the front end of the paper printed passed the second sensor.

The indicating part 270 receives an indication signal from the controlling part 210 which receives a signal representing an occurrence of a paper jam from the sensing part 250, and confirms whether the printer is in a paper jam state or in a printable state.

The indicating part 210 of the printer or a displaying part 510 of a host 500 illustrates whether the printer is in the paper jam state or in the printable state.

Figure 4:
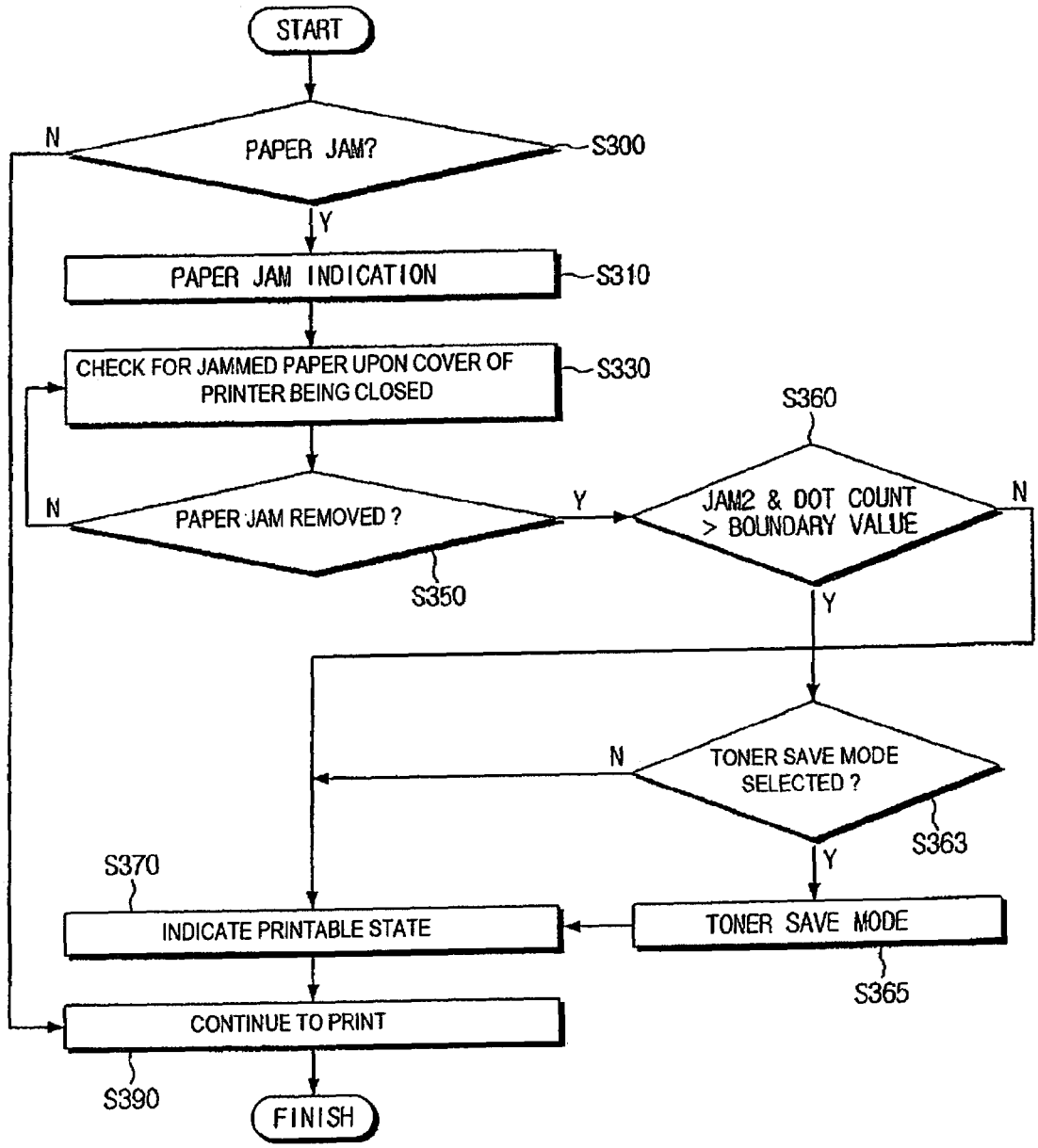
FIG. 4 is a flowchart illustrating a jam removing method according to an embodiment of the present general inventive concept.

FIG. 4 is a flowchart illustrating a jam removing and/or printing. The host 500 is connected to the printer through a wire or wireless communication to output data such that the printer prints an image corresponding to the data according to an embodiment of the present general inventive concept.

Referring to FIGS. 3 and 4, the sensing part 250 detects the occurrence of the paper jam in operation S300.

If there is no paper jam, the sensing part 250 does not send any separate signal to the controlling part 210 and the printing continues in operation S390. If there is a paper jam, the sensing part 250 sends a paper jam occurrence signal to the controlling part 210. The controlling part 210 receives JAM0, JAM1, and JAM2 indication signals of the sensing part 250 and transmits a signal to stop on operation of the engine part 230.

If the engine part 230 receives the above-mentioned signal from the controlling part 210, the engine part 230 stops printing, until a user removes a paper jammed.

The controlling part 210 transmits the indication signal such that the indicating part 270 indicates the occurrence of the paper jam. The indicating part 270 receives the above-mentioned signal and indicates the occurrence of the paper jam in operation S310.

A user confirms the indication signal of the paper jam on the indicating part 270 and removes the paper jammed, manually. The printer includes a cover through which a user can remove the jammed paper. The user opens the cover to take out the jammed paper. The user closes the cover of the printer and the sensing part 250 confirms that the paper jammed is removed whenever the cover of the printer is closed in operation S330.

The sensing part 250 confirms whether the paper jammed was removed or not and transmits a signal representing that the jammed paper has been removed, to the controlling part 210. The controlling part 210 judges whether the paper was removed through the received signal in operation S350.

If the controlling part 210 judges that the paper was removed, the controlling part 210 confirms whether the signal received from the sensing part 250 upon the paper jam is the JAM2 indication signal.

The controlling part 210 confirms whether a signal received from the sensing part 250 in the occurrence of the paper jam is the JAM2 indication signal, and whether the dot count value received from the dot counting part 200 exceeds a preset boundary value in operation S360, which indicates to the controller that the JAM2 paper jam may have been caused by the image density and may be avoided in subsequent printing operations by converting the printing mode into the toner save mode.

The present boundary value may be set in a designing process of the printer. According to the present embodiment, a maximum value of the dot count values may be '32, 434, 640', '29, 191,176', 90% of the maximum values, are set as the boundary values.

In a case that the paper jam is JAM2 and the dot count value exceeds the preset boundary value as a result of confirmation by the controlling part 210, either the indicating part 270 of the printer or the displaying part 510 of the host 500 indicates a message to request a user to select whether to convert a printing operation (mode) into a toner save mode in operation S363.

A user can select to convert the printing mode into the toner save mode in the printer or through a host driver 520 of the host 510 and when the user selects the toner conversion, the controlling part 210 converts the printing mode into the toner save mode in operation S365.

In the present embodiment, the setting may be performed in the printer itself or through the host driver 520 to control the printing mode, such that the user can automatically select the toner save mode without performing the above-mentioned selection operations S363 and S365.

The controlling part 210 transmits a signal to the indicating part 210 so that the indicating part 270 indicates the printable state, and the indicating part 270 receives the above-mentioned signal from the controlling part 270 and indicates the printable state in operation S370.

The controlling part 210 transmits a printing instruction signal in the toner save mode to the engine part 230, and sends the image which has been failed to be printed due to the paper jam. When the engine part 230 receives the above-mentioned signal, the engine part 230 continues to perform the printing of the image that has been failed to be printed due to the paper jam in operation S390.

If the user does not select the toner conversion, the controlling part 210 indicates the printable state in operation S370, without converting the printing mode into the toner save mode, and continues to print S390.

If the paper jam is not JAM2 or the dot count value does not exceed the preset boundary value, as a result of confirmation by the controlling part 210 in operation S360, the controlling part 210 does not convert the printing mode into the toner save mode.

In a case that the dot count value exceeds the preset boundary value, a user does not convert the printing mode into the toner save mode because a user does not want to convert the printing mode into the toner save mode in printing the image, in a case that there was no paper jam, even if the dot count value already exceeded the preset boundary value.

That is, a user may recognize that the printer does not have a good printing quality when the printing is performed in the toner save mode, according to characteristics of the image to be printed.

Although the dot count value exceeded the preset boundary value, it is possible that the paper jam does not necessarily occur when the image has a high image density.

The occurrence of the paper jam by the image density may be caused by other reasons corresponding characteristics of the toner used for printing (for example, a user may use a refill toner.), paper quality, and a fixing temperature.

The toner save mode may not be unconditionally set, regardless of the occurrence of JAM2, because the preset boundary value may not be accurate and reasonable.

As described above, according to an embodiment of the present general inventive concept, there may be the paper jam by the image density which should be prevented from repeating, such that successive paper jam is prevented from occurring, and user's convenience may be enhanced and the toner may not be wasted.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A jam removing method comprising:

detecting a paper jam on a printing route in a printer;

confirming whether a dot count value of a corresponding image exceeds a preset boundary value; and converting a printing mode into a toner save mode when the dot count value exceeds the boundary value.

2. The jam removing method of claim 1, wherein the detecting of the paper jam comprises detecting when a rear end of a paper fails to pass a sensor within a predetermined time interval of when a front end of the paper passes the sensor.

3. The jam removing method of claim 2, wherein the detecting of the paper jam comprises determining that the paper jam is due to an image density upon the rear end of the paper failing to pass the sensor within the predetermined time interval and the dot count value exceeding the preset boundary value.

4. The jam removing method of claim 1, wherein the converting of the toner save mode comprises indicating the conversion of the toner save mode on either an indicating part of the printer or a displaying part of a host.

5. The jam removing method of claim 4, wherein the converting of the toner save mode comprises setting a driver to automatically convert the printing mode into the toner save mode upon the detecting of the paper jam.

6. The jam removing method of claim 1, further comprising:

re-printing an image that has failed to be printed due to the paper jam, after the conversion of the toner save mode.

7. The jam removing method of claim 1, wherein the detecting of the paper jam comprises indicating a paper jam state representing the detected paper jam.

8. The jam removing method of claim 1, wherein the converting of the printing mode into the toner save mode comprises indicating a printable state after the conversion of the toner save mode.

9. The jam removing method of claim 1, wherein the dot count value is a preset value or set by a user.

10. An image forming apparatus comprising:

a sensing part to sense a paper jam on a printing route;

a dot counting part to output a dot count value of the corresponding image upon an occurrence of the paper jam; and a controlling part to convert a printing mode into a toner save mode when the dot count value transmitted from the dot counting part exceeds a preset boundary value.

11. The image forming apparatus of claim 10, wherein the sensing part comprises a sensor to detect the paper jam as a failure to detect a rear end of a paper a predetermined time interval after the front end of the paper passes the sensor.

12. The image forming apparatus of claim 11, wherein the controlling part determines that the paper jam occurs due to an image density when the paper jam is detected by the sensor.

13. The image forming apparatus of claim 10, further comprising: one of an indicating part of a printer or a displaying part of a host to indicate the converted toner save mode.

14. The image forming apparatus of claim 13 further comprising:

a driver to provide a user selection to the controller to convert the print mode automatically into the toner save mode upon the sensing part detecting the print jam.

15. The image forming apparatus of claim 10, further comprising:

an engine part to re-start printing in the toner save mode according to a command from the controlling part.

16. The image forming apparatus of claim 10, further comprising:

an indicating part to indicate a paper jam state upon detecting the paper jam and a printable state after converting the printing mode into the toner save mode.

17. The image forming apparatus of claim 10, wherein the dot count boundary value is a preset value or settable by a user.

18. An image forming apparatus comprising:

a sensing part to detect an occurrence of a paper jam; and a controlling part to convert a printing mode into a toner save mode when the paper jam has occurred due to an image density.

19. The image forming apparatus of claim 18, further comprising:

an engine part to re-start printing in the toner save mode according to a command from the controlling part.

20. An image forming system comprising:

a sensing part to sense a failure of a printing operation of printing an image on a printing medium with a first image density; and a controlling part to change the first image density of the image to a second image density according to the sensed failure of the printing operation.

21. An image forming system comprising:

a sensing part to sense a malfunction in a paper feed operation during printing of an image; and a controlling part to change an image density of the image according to the malfunction.

22. An image forming apparatus comprising:

a sensing part to sense a jam of a printing medium; and a controlling part to change a printing mode having a first printing quality into a toner save mode having a second printing quality to print according to the sensed jam of the printing medium.

23. An image forming apparatus comprising:

a sensor to detect a location of a paper jam during printing an image with an amount of toner; and a controlling part to determine whether the location of the paper jam corresponds to a location where the first amount of toner is fixed to a printing medium and, upon a positive determination thereof, to generate a signal to reprint the image using a decreased amount of toner.

* * * * *